United States Patent [19]

Gottling et al.

[11] Patent Number: 5,035,171

[45] Date of Patent: Jul. 30, 1991

[54] WORKING CYLINDER AND TENSION MEMBER THEREFOR

[75] Inventors: Helmut Gottling, Isernhagen; Rudolf Moller, Gehrden; Peter Muller, Hanover; Gerhard Scharnowski, Gehrden, all of Fed. Rep. of Germany

[73] Assignee: WABCO Westinghouse Steuerungstechnik GmbH & Co., Hanover, Fed. Rep. of Germany

[21] Appl. No.: 480,739

[22] Filed: Feb. 16, 1990

[30] Foreign Application Priority Data

Feb. 23, 1989 [DE] Fed. Rep. of Germany ..... 3905561

[51] Int. Cl.[5] ..... F01B 9/00

[52] U.S. Cl. ..... 92/137; 74/89.22; 74/502.5; 474/141; 92/177

[58] Field of Search ..... 92/137, 140, 161, 146, 92/177, 165 R, 88; 74/89.2, 89.22, 110, 502.5; 474/141, 237, 239

[56] References Cited

U.S. PATENT DOCUMENTS

| | | | |
|---|---|---|---|
| 2,524,271 | 10/1950 | Rappl . | |
| 3,745,888 | 7/1973 | Boretti . | |
| 4,052,911 | 10/1977 | Feldstein | 74/502.5 |
| 4,057,257 | 11/1977 | Berg | 92/137 |
| 4,121,840 | 10/1978 | Berg | 92/137 |
| 4,796,515 | 1/1989 | Dry | 92/137 |
| 4,802,378 | 2/1989 | Memmola | 74/501.6 |

FOREIGN PATENT DOCUMENTS

| | | | |
|---|---|---|---|
| 8801698 | 3/1988 | European Pat. Off. . | |
| 1293037 | 4/1969 | Fed. Rep. of Germany . | |
| 2359013 | 5/1975 | Fed. Rep. of Germany . | |
| 2404244 | 8/1975 | Fed. Rep. of Germany . | |
| 2519251 | 11/1976 | Fed. Rep. of Germany . | |
| 2800318 | 7/1979 | Fed. Rep. of Germany | 92/137 |
| 3005193 | 1/1981 | Fed. Rep. of Germany . | |
| 2938332 | 3/1981 | Fed. Rep. of Germany . | |
| 2939153 | 4/1981 | Fed. Rep. of Germany . | |
| 3317113 | 11/1984 | Fed. Rep. of Germany . | |
| 3505167 | 8/1986 | Fed. Rep. of Germany . | |
| 2051957 | 1/1981 | United Kingdom . | |

*Primary Examiner*—Edward K. Look
*Assistant Examiner*—Thomas Denion
*Attorney, Agent, or Firm*—Buchanan Ingersoll; Barry I. Friedman

[57] ABSTRACT

A working cylinder is described which features a cylinder of compact construction. The openings provided for the tension member can be very well sealed by simple means. The tension element features a cross-section having a continuous circumferential line. The size of the cylinder is also reduced through the use of a generally elliptical piston. The tension element is preferably comprised of several plastic tension strands encased in a jacket of plastic material which also has a generally elliptical cross-sectional shape.

13 Claims, 3 Drawing Sheets

WORKING CYLINDER AND TENSION MEMBER THEREFOR

BACKGROUND OF THE INVENTION

1. Field of the Invention

The present invention relates to a working cylinder actuated by a pressure medium. More specifically, the invention relates to a compact working cylinder utilizing a tensioning member which has a continuous circumference.

2. Description of the Prior Art

The prior art is characterized by the device shown in West German Patent No. DE-OS 24 04 244, also shown in FIG. 1 herein. The device features a cylindrical tube, in which a piston with circular cross-section moves under seal. A tension member is mounted at the piston faces, which are directed away from each other. The tension member is designed as a flat belt, and is passed, under seal, out of the front ends of the cylindrical tube, which are also facing away from each other. The seals for the rectangular belt are generally of a "wiper" type design.

One disadvantage of the prior art cylinder is its height. The circular cross-section of the piston and cylinder necessitates a square cross-sectional main body, which is added to the additional height of a cam, which is slidably mounted on the top surface of the main body. An additional disadvantage of the prior art cylinder is that the rectangular cross-sectional shape of the tension member cannot be reliably sealed as it enters and exits the cylinder.

What is lacking in the art, therefore, is a working cylinder which is compact in design, notably in its height. Additionally, a hydraulically actuated working cylinder which guarantees a reliable seal of the opening for the tension member is needed.

SUMMARY OF THE INVENTION

A working cylinder is described which features a cylinder of compact construction and whose working chamber can be very well sealed around the tension member by simple means. The tension element features a cross-section having a continuous circumferential line. A continuous circumferential line describes a shape which has a variable radius and is generally elliptical. In any case, the tension member has no corners or discontinuous sections. The outer surface of the tension element is smooth and curved in all aspects. The generally elliptical shape allows for the use of smaller pulleys as deflection elements and reduces the size of the working cylinder. The size of the cylinder is also reduced through the use of an oval or elliptical cross-sectional piston, rather than the conventional circular shape.

The tension element is preferably comprised of several plastic tension strands which provide particularly high tensile strength. The tension strand or strands are encased in a jacket of plastic material which also has the continuous circumference cross-sectional shape. This is generally an elliptical cross-section. This section achieves both a high tensile strength of the tension member and allows for proper sealing of the openings for the tension element in the front walls of the cylinder.

These and other advantages and features of the present invention will be more fully understood on reference to the presently preferred embodiments thereof and to the appended drawings.

DESCRIPTION OF THE PREFERRED EMBODIMENTS

Figure 1:
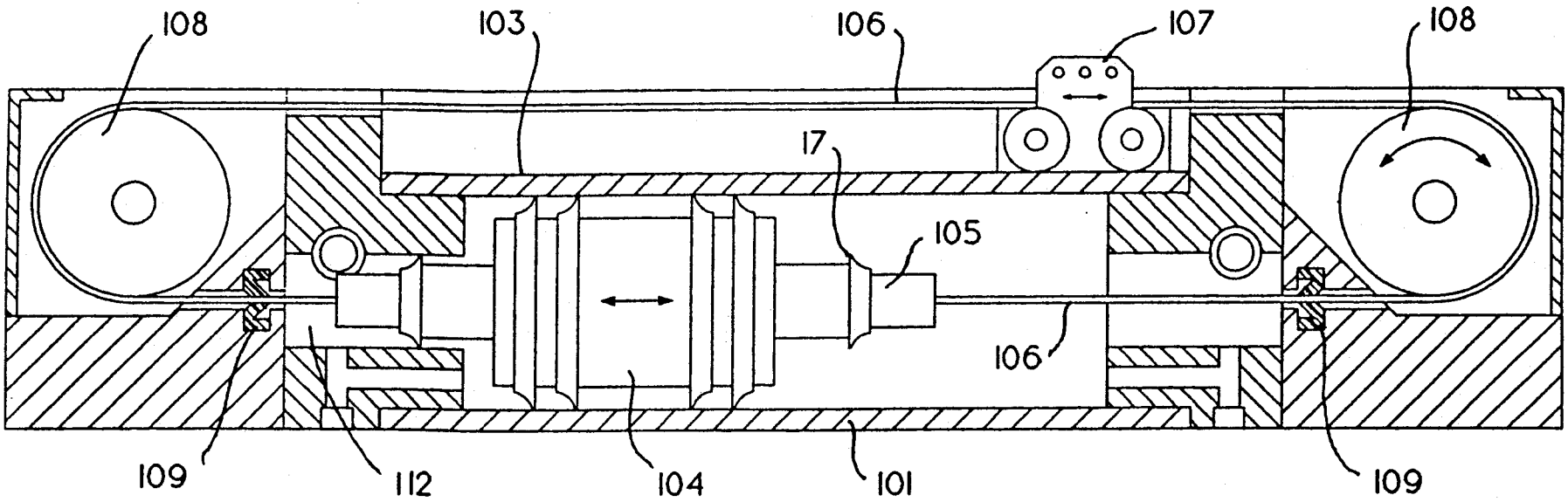
Fig.1. Prior Art
FIG. 1 is a sectional view of a prior art device.

FIG. 1 illustrates a device of the prior art. A cylindrical tube 101, contains a piston 104 with circular cross-section. The piston moves under seal to create a pressure chamber 112 on each side thereof. A tension member 106 is mounted at the piston fronts 105, which face away from each other. The tension member 106 is designed as a flat belt, and is passed, under seals 109, out of the front ends of the cylindrical tube, which are also facing away from each other. The seals 109 for the rectangular belt are generally of a "wiper" type design.

A cam 107 is connected to the tension member 106, with the tension member 106 being run across deflection elements 108 located at the cylinder fronts. A guide 103 for the cam 107 is provided on the surface of the cylinder 101 oriented in the direction of the longitudinal axis of the cylinder 101. When the piston 104 moves in the direction of the longitudinal axis of the cylinder 101, the cam 107 is also moved, by means of the tension element 106, in the direction of the longitudinal axis of the cylinder.

Figure 2:
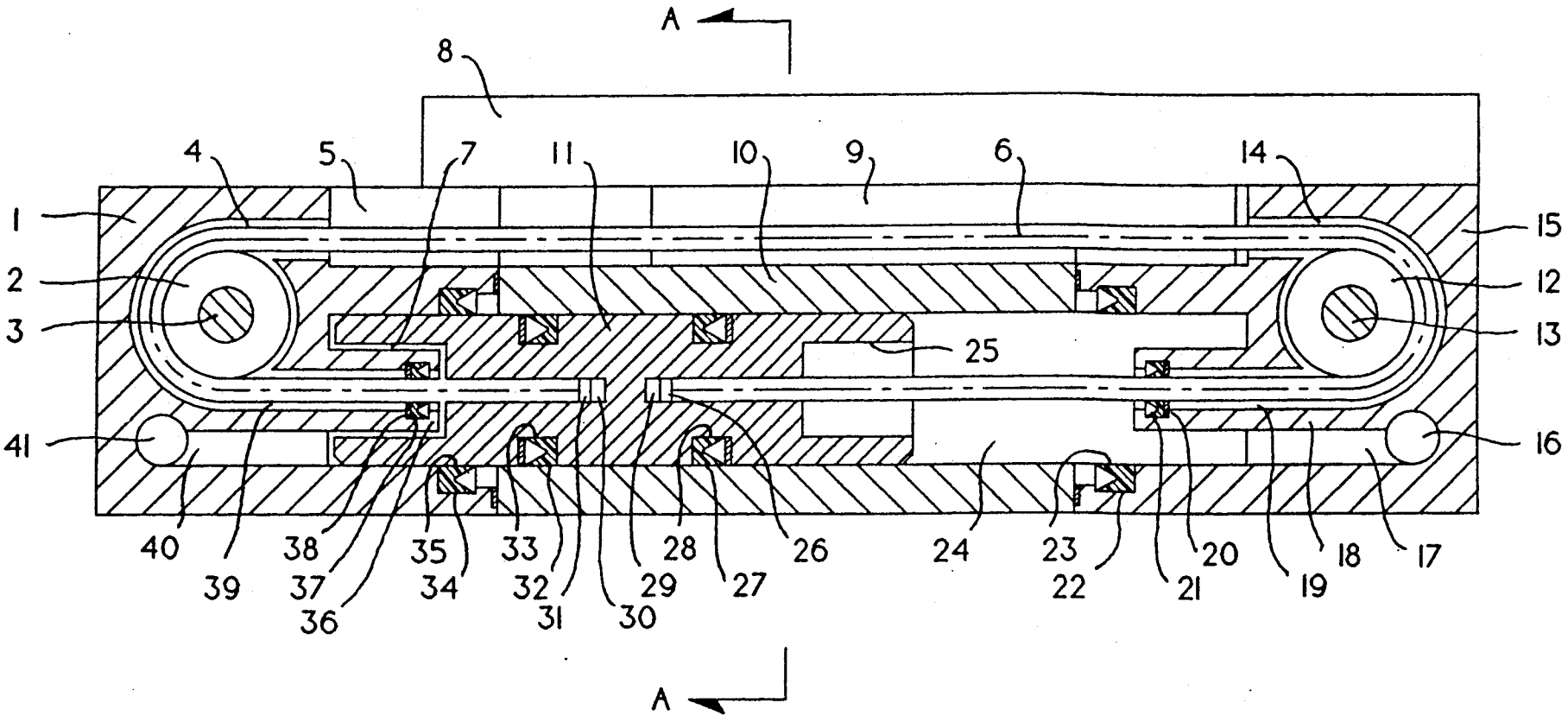
FIG. 2 is a sectional view of a first embodiment of the improved working cylinder, showing the tensioning member in place.

Referring to FIG. 2, an improved working cylinder is shown. A cylindrical tube 10 is sealed at its two front ends by a first cover 1 and a second cover 15. In the cylindrical tube 10 a piston 11 is located that moves under seal by sealing means 27 and 32, which are preferably rings. Sealing means 27 and 32 are mounted in continuous grooves 28 and 33 of the piston 11. The piston 11 and sealing means 27 and 32 divide the cylindrical tube 10 into a first working chamber 40 and a second working chamber 17. The second working chamber 17 is located opposite from the first working chamber 40 on the other side of the piston 11. Interior space 24 is divided between the two working chambers. The front walls of the cylindrical tube 10 are formed by the covers 1 and 15.

A first pressure-medium connection 41 connects the working chamber to a valve device, not shown, and from there to a fluid source, the atmosphere or a return flow. In the same manner, the second working chamber 17 can be optionally connected to the fluid source, the atmosphere or the return flow through pressure medium connection 16 and a valve device.

The first cover 1 features a circumferential groove 34 in the area adjoining the cylindrical tube 10. A packing ring 35 is mounted within the groove 34. The second cover 15 also features a circumferential groove 22, having a packing ring 23 inserted therein. Packing rings 23 and 35 are preferably designed as slot rings. The leading edges of piston 11 are preferably beveled to prevent cutting or displacement of the packing rings 23 and 35. The first and second covers 1 and 15 are further provided with tubular extensions 36 and 18, respectively, which extend into the interior space 24 of the cylindrical tube 10. The first tubular extension 36 extends into the first working chamber 40, while the second tubular extension 18 extends into the second working chamber 17.

Within the first cover 1, a first pulley 2, functioning as a deflection element, is mounted so as to turn on an axle 3 transverse to the longitudinal axis of the cylindrical tube 10. In the second cover 15, a second pulley 12, also functioning as a deflection element is mounted so as to turn on an axle 13 located transverse to the longitudinal axis of the cylindrical tube 10. The free internal space of the tubular extension 36 of the first cover 1 and the free internal space of the tubular extension 18 of the second cover 15 function as a first channel 39 and as a second channel 19 through which tension member 6 is passed.

The tension member 6 is secured at one end 30 to one side of the piston 11 in a mount 31 provided in the piston 11. The tension member 6 is passed through the channel 39 in the first cover 1, partially loops around the first pulley 2 and is passed through clearance 4. The tension member 6 then passes out of the first cover 1 and runs parallel to the outer jacket surface of the cylindrical tube 10 toward the second cover 15. The tension member 6 enters into a clearance 14 of the second cover 15, partially loops around the second pulley 12 and exits into interior space 24 from the second channel 19 of the second cover 15. The tension member 6 is then secured at its end 29 to the side of piston 11 that faces the second cover 15 by a mount 26.

To prevent the escape of pressure medium from the first working chamber 40 through channel 39, the space for the pulley 2 and clearance 4 in the first cover 1, a packing ring 38 is placed in a continuous groove provided in the interior wall of the tubular extension 36. This encloses the tension member 6 at this point while forming a seal. Likewise, a packing ring 21 is placed in a continuous groove provided in the interior wall of the tubular extension 18 of the second cover 15. This prevents the escape of pressure medium from second working chamber 17 through the first channel 19, the space for the pulley 12 and the clearance 14 in the second cover 15. Both packing rings 38 and 21 are preferably designed as slot rings.

In the area from where the tension member 6 exits from the covers 1 and 15, the sectional tube features a guide 5, running in the direction of the longitudinal axis of the cylinder, for a cam 8. This is generally on the upper surface of the cylindrical tube 10, as viewed in FIG. 1. The cam 8 is connected to the tension member 6 in such a way that during a sliding motion of the piston 11, the cam 8 moves, by means of the tension member 6, in a longitudinal direction of the cylinder. A guide 5 is provided in the upper surface of the working cylinder, as shown in FIG. 2. Cam 8 has a slide member 9 affixed thereto, which slidingly engages guide 5, and moves longitudinally to the axis of the cylinder.

Piston 11 features cup-shaped recesses 7 and 25 at each end. These recesses 7 and 25 surround and interact with the tubular extensions 36 and 18, respectively, in such a manner that in the respective end position of the piston 11 the corresponding tubular extension 36 or 18 is immersed into the associated recess 7 or 25 of the piston 11.

Figure 3:
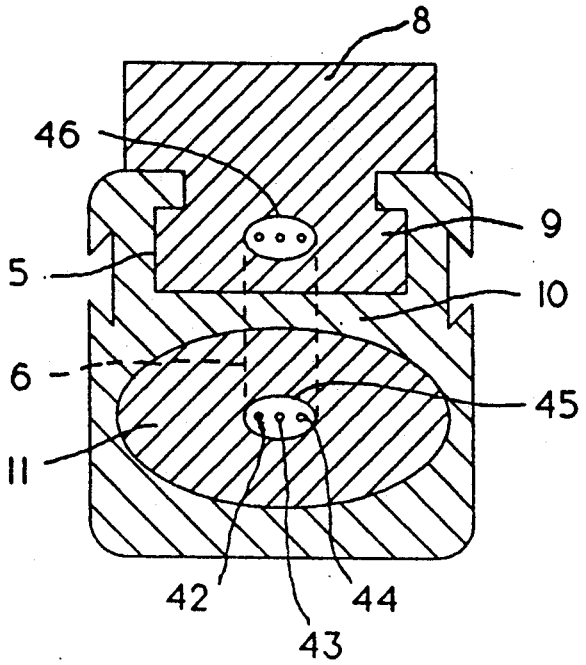
FIG. 3 is a sectional view of the device of FIG. 2, taken along line A—A.

Referring to FIG. 3, the cylinder is illustrated having an oval-shaped cylinder bore, in which the equally oval piston 11 is mounted so as to slide. Piston 11 may also have any other cross-sectional shape, so long it has a continuous circumferential line. It is also preferred that the ellipsoid or other shape be oblate in the direction perpendicular to the longitudinal axis of the cylinder. This reduces the vertical height of the device. It also eliminates any torsion on the piston 11 as it moves in cylindrical tube 10.

The tension member 6 is also preferably oval-shaped, and is secured in the area of the longitudinal axis of the piston 11. The tension member 6 is preferably comprised of three adjacent tension strands 42, 43, 44 which are enclosed by an oval jacket 45 common to all tension strands 42, 43, 44. The jacket 45 is preferably made of plastic. It is specifically intended that any number of tension strands may be provided.

Figure 4:
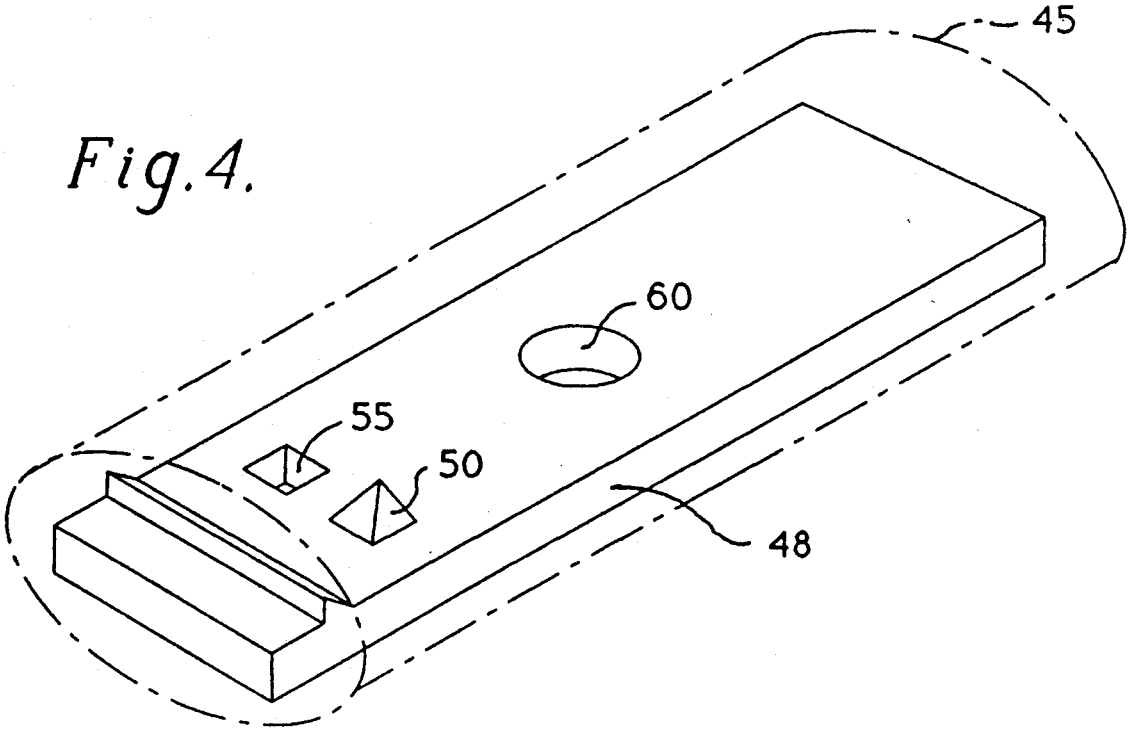
FIG. 4 is an isometric view of a second embodiment of the tensioning member shown in FIGS. 2 and 3.

As shown in FIG. 4, it is also specifically intended that a single flat belt-type tension strand 48 may be provided, surrounded by a similar oval jacket 45. The flat belt-type tension strand 48 may feature raised areas, as exemplified by protrusion 50; recessed areas, as exemplified by dimple 55; or perforations 60 to prevent tension strand 48 and jacket 45 from shifting in opposite directions. For example, if perforations 60 are provided, the jacket material can penetrate the perforations during the sheathing process, creating web-like connectors between the jacket on one side of the tension strand and the jacket on the opposite side of the tension strand.

The tension member is specifically designed to have a uniform peripheral line, which is preferably other than circular. The tension member preferably has a cross-sectional shape other than circular, so that the tension member is protected against torsion. The extension of the cross-section which is transverse to the plane in which the tension member is guided should be considerably greater than in the direction vertical to it. The tension strand or tension strands may consist of a metallic material such as steel or of a plastic such as aramid fiber. The jacket enveloping the tension strand or tension strands is preferably made of a plastic material such as polyurethane. When using a tension strand of a heavy-duty plastic, no sheathing is required. Packing rings 21 and 37 are specifically adapted to have the same cross-section as the tension member to facilitate a proper seal therebetween.

Referring again to FIGS. 2 and 3, the piston 11 is mounted in the cylindrical tube 10 so that the plane of its largest diameter is essentially parallel to the transverse axis of the guide 5 for the cam 8. The tension member 6 is also mounted such that, for the sections between the two pulleys 2 and 12, its largest diameter is essentially parallel to the transverse axis of the guide 5. The cam 8 runs in the direction of the longitudinal axis of the cylindrical tube 10. The tension member 6 is linked to the cam 8 at linkage point 46. This linkage point 46 is within slide member 9, and is specifically located such that the tension member 6 remains parallel to the lower surface of guide 5 and to the longitudinal axis of cylindrical tube 10.

While we have described a present preferred embodiment of the invention, it is to be distinctly understood that the invention is not limited thereto but may be otherwise embodied and practiced within the scope of the following claims.

We claim:

1. An improved working cylinder of the type actuated by a pressure medium, having a cam driven by a piston in conjunction with a flexible tension member, the tension member being passed, under seal, through respective ends of a cylinder in which the pressure medium is introduced, the cam adapted to run in a guide in a longitudinal direction with relation to the cylinder, the improvement comprising the tension member having a cross-section of variable radius with a uniform continuous outer peripheral line.

2. An improved working cylinder as described in claim 1, wherein the cross-section of the tension member transverse to the plane in which the tension member is guided is greater than that of the direction vertical to it.

3. An improved working cylinder as described in claim 1, wherein the tension member has an oval cross-section.

4. An improved working cylinder as described in claim 1, wherein the tension member has an elliptic cross-section.

5. An improved working cylinder as described in claim 1, wherein the tension member is further comprised of at least one tension strand which is enclosed by a jacket.

6. An improved working cylinder as described in claim 5, wherein the tension strand is at least partially comprised of metallic material.

7. An improved working cylinder as described in claim 5, wherein the jacket is comprised of a plastic material.

8. An improved working cylinder as described in claim 5, wherein at least one of the tension strands is comprised of plastic material.

9. An improved working cylinder as described in claim 1, wherein the tension member is further comprised of a belt-shaped tension strand which is enclosed by a jacket.

10. An improved working cylinder as described in claim 9, wherein the belt-shaped tension strand is comprised of raised areas which prevent relative movement between the jacket and the tension strand.

11. An improved working cylinder as described in claim 9, wherein the belt-shaped tension strand is comprised of recessed areas which prevent relative movement between the jacket and the tension strand.

12. An improved working cylinder as described in claim 9, wherein the belt-shaped tension strand has at least one perforation, through which web-like parts of the jacket penetrate and which connect a portion of the jacket located on one side of the tension strand to a portion of the jacket located on another side of the tension strand.

13. An improved working cylinder as described in claim 1, wherein the cross-section of the piston transverse to the plane in which the piston is guided is greater than that of the direction vertical to it.

* * * * *